United States Patent [19]

Hasebe et al.

[11] Patent Number: 4,498,518

[45] Date of Patent: Feb. 12, 1985

[54] CONTINUOUS CASTING MOLD PROVIDED WITH ULTRASONIC VIBRATORS

[75] Inventors: Nobuhisa Hasebe; Hiroshi Kawada, both of Yokohama; Isamu Komine, Yokosuka, all of Japan

[73] Assignee: Nippon Kokan Kabushiki Kaisha, Tokyo, Japan

[21] Appl. No.: 572,962

[22] Filed: Jan. 23, 1984

Related U.S. Application Data

[63] Continuation of Ser. No. 473,978, Mar. 11, 1983, abandoned, which is a continuation of Ser. No. 213,043, Dec. 4, 1980, abandoned.

[30] Foreign Application Priority Data

Dec. 21, 1979 [JP] Japan ..... 166365/79

[51] Int. Cl.[3] ..... B22D 11/04

[52] U.S. Cl. ..... 164/416; 164/418; 164/478

[58] Field of Search ..... 164/418

[56] References Cited

U.S. PATENT DOCUMENTS 3,075,264 1/1963 Wognum ..... 164/478 X 3,672,436 6/1972 Wognum et al. ..... 164/478 X

FOREIGN PATENT DOCUMENTS 86432 7/1979 Japan ..... 164/478

1222988 2/1971 United Kingdom .

*Primary Examiner*—Kuang Y. Lin

*Attorney, Agent, or Firm*—Frishauf, Holtz, Goodman & Woodward

[57] ABSTRACT

In a continuous casting mold which comprises: a plurality of ultrasonic vibrators, fitted to the outer surface of each of the side walls of said mold, along a plurality of straight lines at prescribed intervals in the axial direction of said mold, and said plurality of straight lines being arranged at prescribed intervals; the improvement characterized in that: each of the side walls of said mold is divided into a plurality of sections corresponding to said straight lines of said plurality of ultrasonic vibrators fitted to the outer surface of each of said side walls.

4 Claims, 3 Drawing Figures

CONTINUOUS CASTING MOLD PROVIDED WITH ULTRASONIC VIBRATORS

This application is a continuation of application Ser. No. 473,978, filed Mar. 11, 1983, abondoned, which is a continuation of application Ser. No. 213,043, filed Dec. 4, 1980, abandoned.

FIELD OF THE INVENTION

The present invention relates to a continuous casting mold which is used for a continuous casting machine.

BACKGROUND OF THE INVENTION

Continuous casting of steel is generally conducted with the use of a continuous casting machine comprising a tundish, a mold, a group of guide rolls, and a group of pinch rolls. Continuous casting machines are broadly classified into the vertical type continuous casting machine and the horizontal type continuous casting machine. In the case of a vertical type continuous casting machine, molten steel charged into the tundish is poured through an immersion nozzle provided in the bottom wall of the tundish into the mold. The molten steel cooled in the mold forms a solidified shell. The molten steel having thus formed the solidified shell is withdrawn, while being guided by the group of guide rolls sequentially arranged below the mold, through the group of pinch rolls. In the meantime, the solidified shell, cooled by cooling water sprayed from a plurality of nozzles arranged between said rolls, gradually increases the thickness thereof, and forms a continuously cast strand having a prescribed cross-sectional shape.

In the above-mentioned continuous casting operation, there is a problem of the molten steel seizing to the inner surface of the mold at the time of withdrawing the molten steel having formed the solidified shell from the mold. It is therefore the usual practice to vibrate the mold with a certain amplitude in the withdrawing direction of the cast strand with a view to preventing seizure of molten steel to the inner surface of the mold. This vibration of the mold has usually been effected by a mechanical means. However, in order to vibrate a mold by a mechanical means, it was necessary to provide large-scale facilities with huge quantities of energy. In addition, a mechanical means, which is difficult to vibrate the mold at a high frequency, causes wavy vibration marks on the cast strand surface under the effect of mold vibration, which may in turn cause surface cracks of the cast strand and was therefore problematic in terms of the quality of cast strand.

Recently, the horizontal type continuous casting machine forming a cast strand by horizontally withdrawing molten steel having formed a solidified shell from a horizontal mold provided at the lower part of a side wall of the tundish has been industrially applied because of the low installation costs and other advantages. In the case of this horizontal type continuous casting machine, the horizontal mold is directly connected to the lower part of a side wall of the tundish. It was therefore impossible to vibrate the horizontal mold alone by a mechanical means.

In order to solve the above-mentioned problems, we have proposed a vibrating apparatus of a continuous casting mold, disclosed in Japanese Patent Provisional Publication No. 86,432/79 dated July 10, 1979 (hereinafter referred to as the "Prior art"), which comprises: a plurality of ultrasonic vibrators, fitted to the outer surface of each of the side walls of a continuous casting mold, at prescribed intervals in the axial direction of said mold; said mold being vibrated in the axial direction thereof by the vibration of said plurality of ultrasonic vibrators.

FIG. 1 is a longitudinal section view showing a case of application of the vibrating apparatus of the above-mentioned prior art to a vertical type continuous casting machine; and FIG. 2 is an enlarged cross-sectional view of the mold portion of the vibrating apparatus of FIG. 1. In the drawings, 1 is a tundish; 2 is a molten steel discharge hole provided in the bottom wall of the tundish 1; 3 is a mold arranged below the molten steel discharge hole 2 of the tundish 1; 8 is an immersion nozzle attached to the molten steel discharge hole 2, the lower end of the immersion nozzle 8 being located in the mold 3. The mold 3 is supported by a mold frame 6 provided on the outer peripheral surface thereof. Also in the drawings, 7 is a channel for cooling water provided in the interior of the mold 3. The mold 3 is cooled by cooling water flowing through the channel 7.

A plurality of ultrasonic vibrators 4 are provided on the outer surface of each of the side walls of the mold 3. Said plurality of ultrasonic vibrators 4 are fitted, as shown in FIGS. 1 and 2, along a plurality of straight lines at prescribed intervals in the axial direction of the mold 3 and said plurality of straight lines are arranged at prescribed intervals, to the outer surface of each of the side walls of the mold 3. In the drawings, 3' are projections provided on the outer surface of each of the side walls of the mold 3 for attaching the ultrasonic vibrators 4. In FIG. 1, 5 is an electric source for generating ultrasonic vibration, to which the plurality of ultrasonic vibrators 4 are connected through respective wires 11.

In the mold 3 having the above-mentioned construction, when the plurality of ultrasonic vibrators fitted to the outer surfaces of the side walls thereof are vibrated at a frequency of about 20 kHz, for example, a horizontal vibration wave produced by this vibration is horizontally transmitted to the mold 3. Thus, the vibration wave transmitted to the mold 3 is vertically directed, and as shown in FIG. 1, becomes a longitudinal vibration wave 10 in the axial direction of the mold 3, i.e., along the withdrawal direction of a cast strand 9, to vibrate the mold 3 in the axial direction thereof. The longitudinal vibration wave 10, if caused so that flanks thereof may be located at the both end faces of the mold 3, leads to an efficient vibration of the mold 3. The ultrasonic vibrators 4 are therefore located at positions so that flanks of the longitudinal vibration wave 10 may be located at the both end faces of the mold 3.

The above description represents a case of application of the vibrating apparatus of the prior art to a vertical type continuous casting machine. It is also possible to apply this vibrating apparatus to a horizontal type continuous casting mold. In the case of application to a horizontal type continuous casting mold, ultrasonic vibrators are vertically fitted to the outer surface of each of the side walls of the horizontal mold. The vibration wave transmitted vertically to the horizontal mold is horizontally deviated by an angle of 90°, and can thus vibrate the horizontal mold in the axial direction thereof, i.e., in the horizontal withdrawing direction of a cast strand from the mold.

According to the vibrating apparatus of the above-mentioned prior art, it is possible to vibrate the mold in the axial direction thereof, i.e., in the withdrawing direction of cast strand at a high frequency, thus permitting prevention of seizure of a cast strand to the inner surface of the mold. Unlike a vibrating apparatus based on a mechanical means, this does not require huge quantities of energy nor large-scale facilities, without causing wavy vibration marks on the surface of cast strand under the effect of vibration of the mold. Furthermore, in the application thereof to a mold for a horizontal type continuous casting machine, the fine vibration at a high frequency imparted to the mold keeps a high degree of seal at the junction between the tundish and the xold, without leakage of molten steel from this junction caused by vibration of the mold.

In the vibrating apparatus of the above-mentioned prior art, however, the vibration caused in the mold by the plurality of ultrasonic vibrators becomes a transverse vibration of membrane, since the plurality of ultrasonic vibrators are fitted to the outer surface of each of the side walls of the mold along a plurality of straight lines in the axial direction of the mold at prescribed intervals and said plurality of straight lines are arranged at prescribed intervals. As a result, the vibration wave caused in the mold and the vibration caused by the individual ultrasonic vibrators mutually interfere in the width direction of the mold and offset or damp the vibration waves. This vibrating apparatus of the prior art has therefore been problematic in that the vibrating efficiency given by the ultrasonic vibrators to the mold is accordingly decreased seriously.

SUMMARY OF THE INVENTION

An object of the present invention is, therefore, to provide a continuous casting mold for vibrating the mold at a high efficiency in a continuous casting machine.

In accordance with one of the features of the present invention, in a continuous casting mold which comprises:

a plurality of ultrasonic vibrators, fitted to the outer surface of each of the side walls of said mold, along a plurality of straight lines in the axial direction of said mold at prescribed intervals, and said plurality of straight lines being arranged at prescribed intervals;

the improvement characterized in that:

each of the side walls of said mold is divided into a plurality of sections corresponding to said straight lines of said plurality of ultrasonic vibrators fitted to the outer surface of each of said side walls.

DETAILED DESCRIPTION OF PREFERRED EMBODIMENTS

With a view to solving the above-mentioned problems involved in the prior art for vibrating a continuous casting mold with the use of ultrasonic vibrators, intensive studies were carried out. As a result, a continuous casting mold was developed, as follows:

in a continuous casting mold which comprises:

a plurality of ultrasonic vibrators, fitted to the outer surface of each of the side walls of said mold, along a plurality of straight lines in the axial direction of said mold at prescribed intervals, and said plurality of straight lines being arranged at prescribed intervals;

the improvement characterized in that:

each of the side walls of said mold is divided into a plurality of sections corresponding to said straight lines of said plurality of ultrasonic vibrators fitted to the outer surface of each of said side walls.

Now, the continuous casting mold of the present invention (hereinafter referred to as the "mold of the present invention") is described below by means of an example with reference to a drawing.

Figure 1:
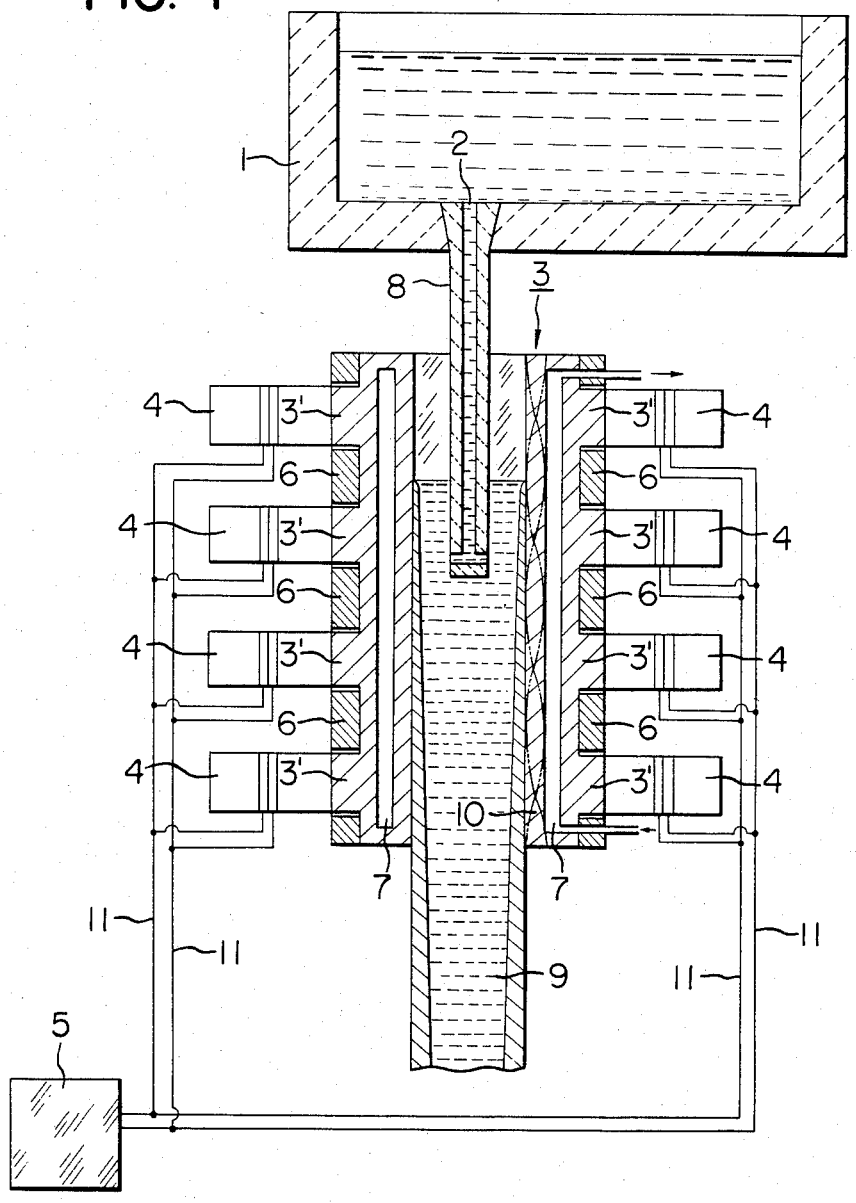
PRIOR ART FIG. 1
FIG. 1 is a longitudinal section view showing an example of the vibrating apparatus of a continuous casting mold of the prior art.
Figure 2:
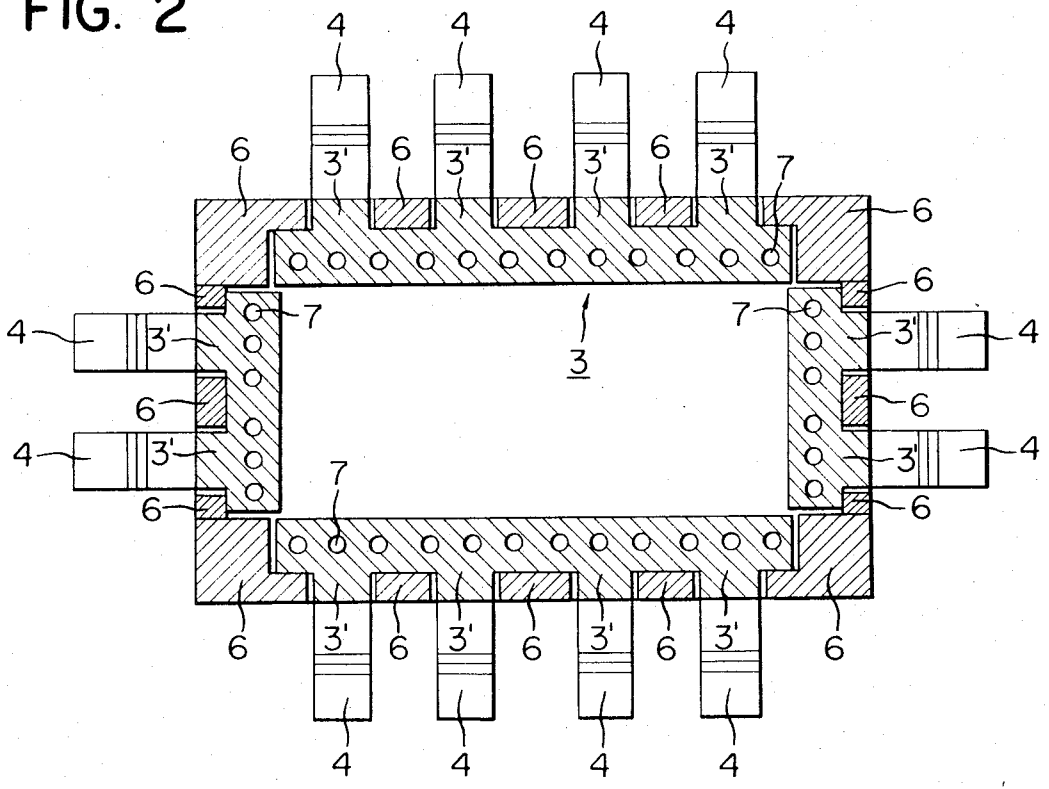
PRIOR ART FIG. 2
FIG. 2 is an enlarged cross-sectional view of the mold portion of the vibrating apparatus of FIG. 1; and, FIG. 3 is a cross-sectional view of the continuous casting mold of the present invention.
Figure 3:
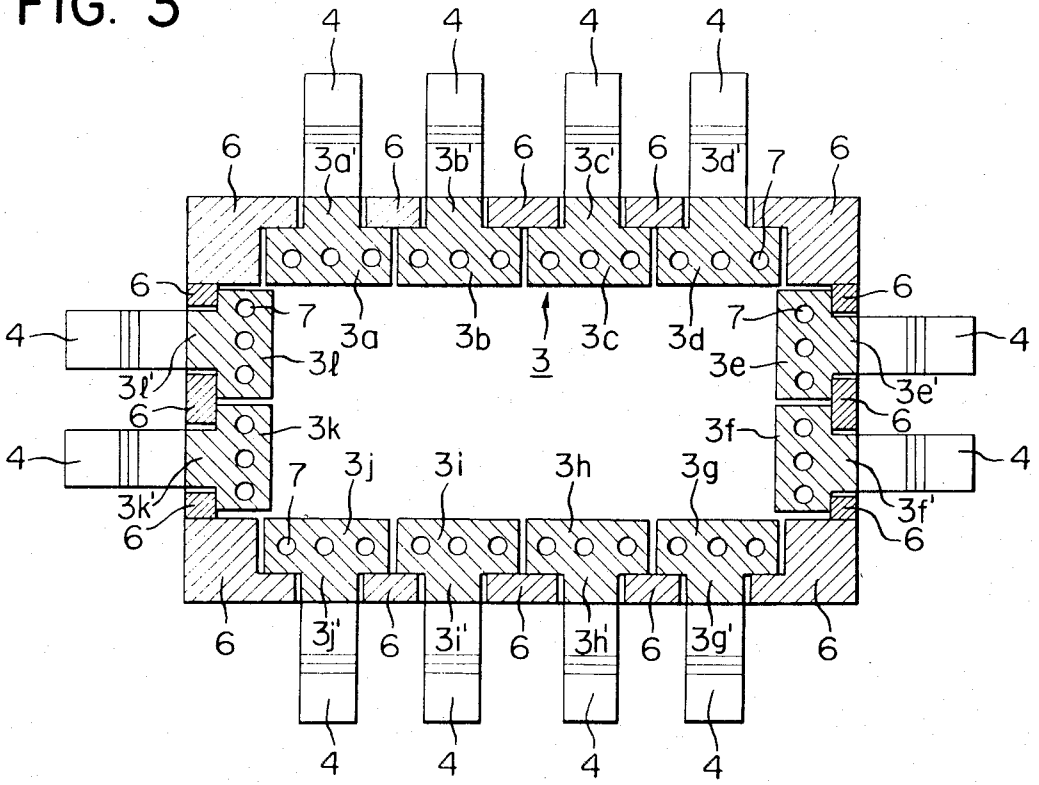

FIG. 3 is a cross-sectional view showing an example of the mold of the present invention. In FIG. 3, the mold 3 is supported by a mold frame 6 provided on the outer peripheral surface thereof; and, 4 are a plurality of ultrasonic vibrators fitted to the outer surface of each of the side walls of the mold 3, along a plurality of straight lines in the axial direction of the mold 3 at prescribed intervals, and said plurality of straight lines are arranged at prescribed intervals.

Each of the side walls of the mold 3 is divided into a plurality of sections corresponding to said straight lines of the plurality of ultrasonic vibrators fitted to the outer surface of each of the side walls of the mold 3 to form mutually independent wall sections 3*a*, 3*b*, 3*c*, 3*d*, 3*e*, 3*f*, 3*g*, 3*h*, 3*i*, 3*j*, 3*k* and 3*l*. On each of said wall sections, a plurality of ultrasonic vibrators 4 are arranged in each of the above-mentioned straight lines at prescribed intervals. In the drawing, 3*a'*, 3*b'*, 3*c'*, 3*d'*, 3*e'*, 3*f'*, 3*g'*, 3*h'*, 3*i'*, 3*j'*, 3*k'* and 3*l'* are projections on said wall sections for attaching the ultrasonic vibrators 4, which projections are not, however, indispensable. Said wall sections are individually supported by the mold frame 6 and the gap between two wall sections is made as small as 0.5 mm, for example, to prevent leakage of molten steel. In each of said wall sections, 7 is a channel for cooling water.

In the mold of the present invention, as described above, each of the side walls of the mold is divided into a plurality of sections corresponding to said straight lines of the plurality of ultrasonic vibrators fitted to the outer surface of each of the side walls of the mold, and is thus composed of a plurality of mutually independent wall sections. The vibration waves caused in the mold by said plurality of ultrasonic vibrators, therefore, never interfere with each other in the width direction of the mold. The vibrating efficiency given by the ultrasonic vibrators to the mold is thus remarkably improved and it is thus possible to vibrate the mold in the axial direction thereof at a high efficiency.

In the above-mentioned example given in FIG. 3, the plurality of ultrasonic vibrators fitted to the outer surface of each of the side walls of the mold in the axial direction thereof along a plurality of straight lines at prescribed intervals are arranged in four straight lines at prescribed intervals on the wide sides of the mold and in two straight lines at prescribed intervals on the narrow sides of the mold. The wide side of the mold is, therefore, divided into four sections and the narrow side, into two sections, whereas the number of straight lines of ultrasonic vibrators fitted to the mold side walls and the number of divided wall sections can be decided, depending upon the mold size and shape. When dividing the mold side walls into a plurality of wall sections, it is not always necessary to completely divide them into independent wall sections as in the example shown in FIG. 3. Wall sections may be formed so that a plurality of sections are connected with a narrow slit in between.

The above-mentioned mold of the present invention is applicable to a vertical type continuous casting machine and to a horizontal type continuous casting machine as well, thereby permitting vibration of the mold in the axial direction thereof at a high efficiency.

According to the mold of the present invention, as described above in detail, it is possible to vibrate the mold in the axial direction thereof at a high efficiency with the use of a plurality of ultrasonic vibrators which are fitted to the outer surface of each of the side walls of the mold in the axial direction thereof along a plurality of straight lines at prescribed intervals and said plurality of straight lines being arranged at prescribed intervals, thereby permitting prevention of seizure of a cast strand to the inner surface of the mold. In the case where the mold of the present invention is applied to a horizontal type continuous casting machine, the mold can be vibrated in the axial direction thereof at a high efficiency in a state in which a perfect seal is maintained at the junction between the tundish and the mold. According to the mold of the present invention, therefore, many industrially useful effects are provided.

What is claimed is:

1. In a continuous casting mold having side walls, and which comprises:

a plurality of ultrasonic vibrators, fitted to the outer surface of each of said side walls of said mold, along each of a plurality of spaced apart straight lines which extend in the axial direction of said mold, said plurality of ultrasonic vibrators fitted along a respective one of said plurality of straight lines being spaced apart from each other at prescribed intervals in said axial direction, said plurality of axially directed straight lines being arranged spaced apart from each other at prescribed intervals in the width direction of said mold, and said side walls of said mold being mutually independent of each other with respect to vibration waves applied by said plurality of ultrasonic vibrators to said side walls;

the improvement wherein:

each of said side walls of said mold comprises a plurality of side wall sections (*3a, 3b, 3c,* etc.) which are spaced apart from each other in the width direction of said mold, each of said plurality of side wall sections corresponding to a respective one of said plurality of straight lines of said plurality of ultrasonic vibrators fitted to the outer surface of each of said side walls, and each of said plurality of side wall sections having, along said respective one of said plurality of straight lines, said plurality of ultrasonic vibrators coupled to the outer surface thereof to apply vibrations to same;

whereby said plurality of side wall sections of each of said side walls of said mold are mutually independent of each other in the width direction of said mold with respect to vibration waves applied by said plurality of ultrasonic vibrators to said plurality of side wall sections, and said vibration waves caused in said plurality of side wall sections of each of said side walls of said mold by said plurality of ultrasonic vibrators substantially do not interfere with each other in the width direction of said mold.

2. The continuous casting mold of claim 1, wherein the space between adjacent ones of said plurality of side wall sections (*3a, 3b, 3c,* etc.) of each of said side walls of said mold is approximately 0.5 mm.

3. The continuous casting mold of claim 1, wherein each of said side wall sections (*3a, 3b, 3c,* etc.) of each of said side walls of said mold has, along said respective one of said plurality of straight lines, a plurality of projections (*3a', 3b', 3c',* etc.) extending toward the exterior of said mold, and each of said plurality of ultrasonic vibrators being attached to a respective one of said plurality of projections.

4. The continuous casting mold of claim 2, wherein each of said side wall sections (*3a, 3b, 3c,* etc.) of each of said side walls of said mold has, along said respective one of said plurality of straight lines, a plurality of projections (*3a', 3b', 3c',* etc.) extending toward the exterior of said mold, and each of said plurality of ultrasonic vibrators being attached to a respective one of said plurality of projections.

* * * * *